United States Patent [19]

Lawson

[11] Patent Number: 5,037,501

[45] Date of Patent: Aug. 6, 1991

[54] HAND HELD MASKING MACHINE

[75] Inventor: Richard A. Lawson, Thousand Oaks, Calif.

[73] Assignee: Minnesota Mining and Manufacturing Company, St. Paul, Minn.

[21] Appl. No.: 486,366

[22] Filed: Feb. 28, 1990

[51] Int. Cl.[5] ..... B26F 3/02; B32B 35/00

[52] U.S. Cl. ..... 156/527; 156/554; 156/577; 156/579; 225/34

[58] Field of Search ..... 156/527, 577, 579, 554; 225/34, 48, 49

[56] References Cited

U.S. PATENT DOCUMENTS 2,916,078 12/1959 Hebert, Jr. ..... 156/554
3,950,214 4/1976 Pool et al. ..... 156/554
4,379,019 4/1983 Pool ..... 156/554
4,906,322 3/1990 Hollier ..... 156/554

*Primary Examiner*—Michael Wityshyn
*Attorney, Agent, or Firm*—Gary L. Griswold; Walter N. Kirn; William L. Huebsch

[57] ABSTRACT

A hand held and manually operable masking machine having a sheet material housing on which is rotatably supported a paper roll and a pair of adhesive tape rolls. One tape roll dispenses adhesive tape to overlap a portion of one edge of the paper roll with the other tape roll dispensing adhesive tape to overlap a portion of the opposite edge of the paper roll. The front edge of the housing is formed into a cutting blade which is to be manually used to cut through the paper roll once the desired extended length has been obtained with this cutting also occurring through the tape that is secured to the side edges to the paper roll.

6 Claims, 2 Drawing Sheets

HAND HELD MASKING MACHINE

BACKGROUND OF THE INVENTION

The field of this invention relates to a masking paper applicator which is to be manually used to apply the masking paper onto selected exterior structures which are to be protected to prevent contamination thereon of a liquid medium such as paint.

Masking has to do with the applying of a sheet material protector for certain structures which are to be protected during the applying of a fluid medium to an area directly adjacent the structure. The typical masking material is paper. It is common to utilize the paper in conjunction with an adhesive tape, known as masking tape, to precisely mask the exterior structure. A typical example of exterior structures that are to be masked during the applying of paint would be automobile bodies and building structure surfaces such as windows which are located directly adjacent a wall that is to be painted.

In the past, it has been common to utilize a machine to facilitate the application of the masking paper. The machine applies a strip of adhesive tape onto one edge of the paper. The combination of the paper with tape along one edge is then used in the best manner possible to mask the desired structural location. Reference is to be had to U.S. Pat. Nos. 3,567,557, 3,950,214 and Reissue 30,787 which are directed to such prior art hand held machines which facilitate the application of masking paper. The primary advantage of these prior art masking machines is that the masking paper can be applied in the desired location by using only one hand of the operator. Also, these masking machines achieve accurate cutting of the masking paper at a desired location.

The primary disadvantage of the prior art masking machines is that the adhesive masking tape is applied only to one edge of the masking paper. This leaves the remaining edge of the masking paper free and unattached to the structure that is being masked. Therefore, a separate attachment is generally required to secure this free edge. There is a need to construct a masking machine which will apply the adhesive masking tape to both edges of the masking paper.

SUMMARY OF THE INVENTION

The structure of the present invention relates to a machine that is to be held by a handle by an operator with this machine to include a roll of masking paper with this roll being rotatably mounted on the housing of the machine. Also mounted on the housing of the machine are a pair of tape rolls with one tape roll to be used to apply masking tape to one edge of the paper roll and the other tape roll to apply the adhesive masking tape to the opposite edge of the paper roll. A portion of each roll of tape extends laterally from the edge of the paper roll. This exposed area of the masking tape is to be applied directly to the exterior structure with the masking paper therebetween covering the selected area of the exterior structure and protect such against unwanted application of a fluid medium such as paint. Both tape rolls are mounted on a single rotational axis with this rotational axis being parallel to the rotational axis of the paper roll. The paper roll is mounted between the front edge of the housing and the tape rolls. The handle is mounted on the back edge of the housing with this handle extending in a downward direction toward and past the bottom surface of the flat planar portion of the housing. The housing may be constructed of a single piece of metallic material and then mechanically deformed in a single forming operation to obtain the shape of the housing with the paper roll and tape rolls to be mounted thereon in an appropriate location.

The primary feature of the present invention is to construct a hand held masking machine which applies a masking paper to a desired location where the masking paper has the masking tape automatically applied to each lateral edge of the paper.

Another objective of the present invention is to construct a hand held masking machine which can be constructed inexpensively and therefore sold to the ultimate consumer at an inexpensive price.

DETAILED DESCRIPTION OF THE SHOWN EMBODIMENT

Figures 1, 2:
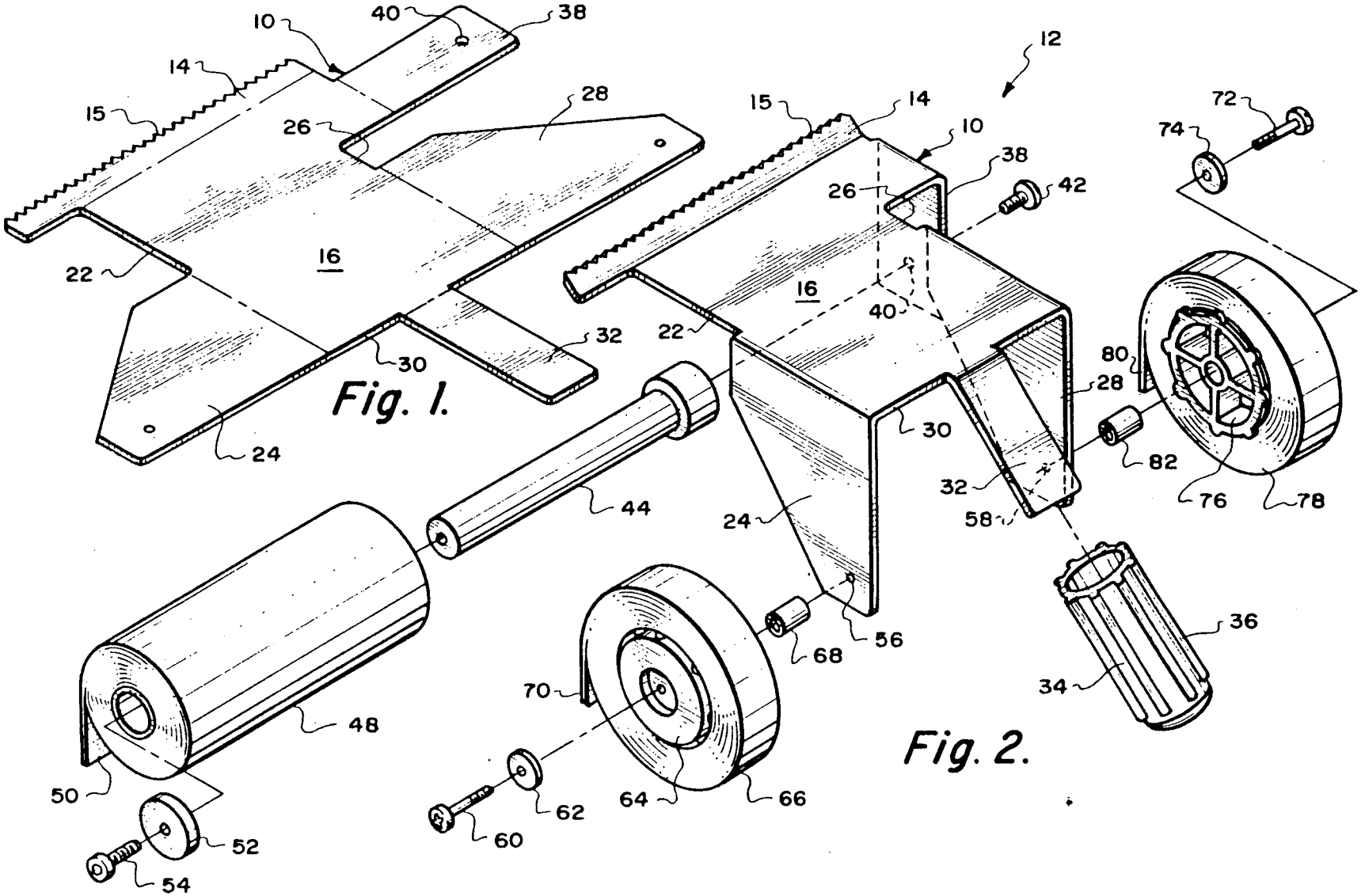
FIG. 1 is an isometric view of the housing that is utilized in conjunction with the machine of the present invention the housing being shown in its initial stage of fabrication prior to being formed into its final shape.
FIG. 2 is an exploded isometric view of the masking machine of the present invention.

Referring particularly to FIG. 1, there is shown housing 10 which is the main structural component of the machine 12 of this invention. The housing 10 may be constructed from a single planar piece of metal. The housing 10 will be formed as shown in FIG. 1 by a stamping operation if the material selected is metal. However, it is considered to be within the scope of this invention that housing 10 could be constructed from plastic if such is deemed to be desired.

Figure 5:
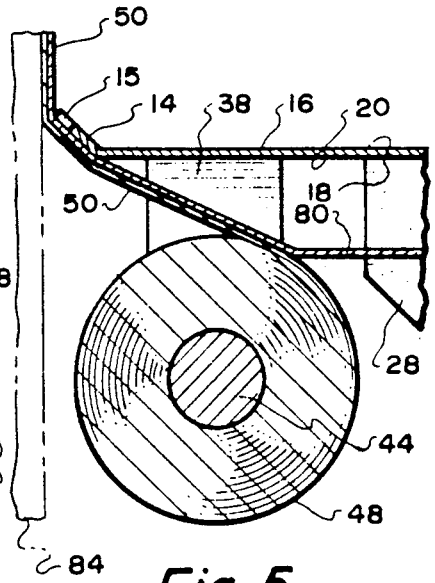
FIG. 5 is a cross-sectional view taken along line 5—5 of FIG. 4.

The housing 10 includes a front edge 14 which includes a series of serrated teeth 15. Located rearwardly of the front edge 14 is the planar main body section 16. This main body section 16 has an upper surface 18 and a bottom surface 20. The front edge 14 is deformed into an upwardly extending inclined angle relative to the main section 16 as is clearly shown in FIG. 5 of the drawings.

The left edge 22 of the main section 16 has a downwardly extending flange 24. The right edge 26 also includes a similar downwardly extending flange 28. The back edges of the flanges 24 and 28 are in alignment and are also in alignment with the back edge 30 of the main section 16. The flanges 24 and 28 are basically identical in shape and are located parallel to each other. Mounted on the back edge 30 is a thin strip of material which is defined as a handle frame 32. On this handle frame 32 is a snugly mounted graspable handle cover 34. The material of construction of the cover 34 will generally be a plastic or other similar type of material. The outer exterior configuration of the cover 34 may include a series of elongated protuberances 36 which are to facilitate grasping onto the cover 34 and holding of such.

It is to be noted that the handle frame 32 is bent in a downward direction, that is, toward the bottom surface 20. This canting of the handle frame 32 is to anatomically facilitate manual grasping and utilization of the hand held masking machine of this invention by the operator. A portion of the right side edge 26 includes a flange 38 which is to be bent to assume a depending downward configuration. This flange 38 includes a hole 40. Through the hole 40 is to be conducted a bolt-type threaded fastener 42. This fastener 42 is to engage within a threaded opening 46 of a shaft 44. The fastener 42 is to be tightened so that the shaft 44 is fixedly secured to the flange 38.

Rotatably supported on the shaft 44 is a paper roll 48. The paper roll 48 includes a paper end 50. This paper end 50 is to be conductable along the bottom of the front end 14 and extend outwardly therefrom which is clearly shown within FIGS. 3 and 5 of the drawings. It is to be understood that manual grasping of paper end 50 and moving of such in an outward direction will result in further unwinding of the paper from the paper roll 48. although the paper roll 48 has been described as comprising of paper, it is to be understood that within the scope of this invention that the paper could be of another type of material such as possibly a thin plastic.

The outer end of the paper roll 48 is held in position on the shaft 44 by means of a washer 52. This washer 52 is fixed to the shaft 44 by means of threaded fastener 54, The flange 24 includes a hole 56. Flange 28 includes a hole 58. Holes 56 and 58 are in alignment and if a line is centrally passed between the holes 56 and 58, it will be discovered that this line Would be parallel to the rotational axis of the paper roll 48. This line is also parallel to the outer surface of the teeth 15.

A threaded fastener 60 is conducted through washer 62 and through the hub portion 64 of a tape roll 66. The fastener 60 then extends through a cylindrical spacing sleeve 68 and then threadably engages with the hole 56. The tape roll 66 is rotatably supported on the spacing sleeve 68. The tape roll 66 has a tape end 70. This tape end 70 is to be adhesively secured to the left lateral edge of the paper end 50 of the paper roll 48. It is to be noted that only about one-half of the width of the tape end 70 is adhesively connected to the paper end 50.

In a similar manner, a threaded fastener 72 extends through a washer 74 which passes through a hub 76 of a tape roll 78. This tape roll 78 is identical to tape roll 66. Tape roll 76 includes a tape end 80. The fastener 72 is then conducted through a spacing cylindrical sleeve 82 and threadably connects With the hole 58. The tape end 80 connects with the right side edge of the paper end 50 in the same manner as tape end 70 engages with the left side edge.

Figure 3:
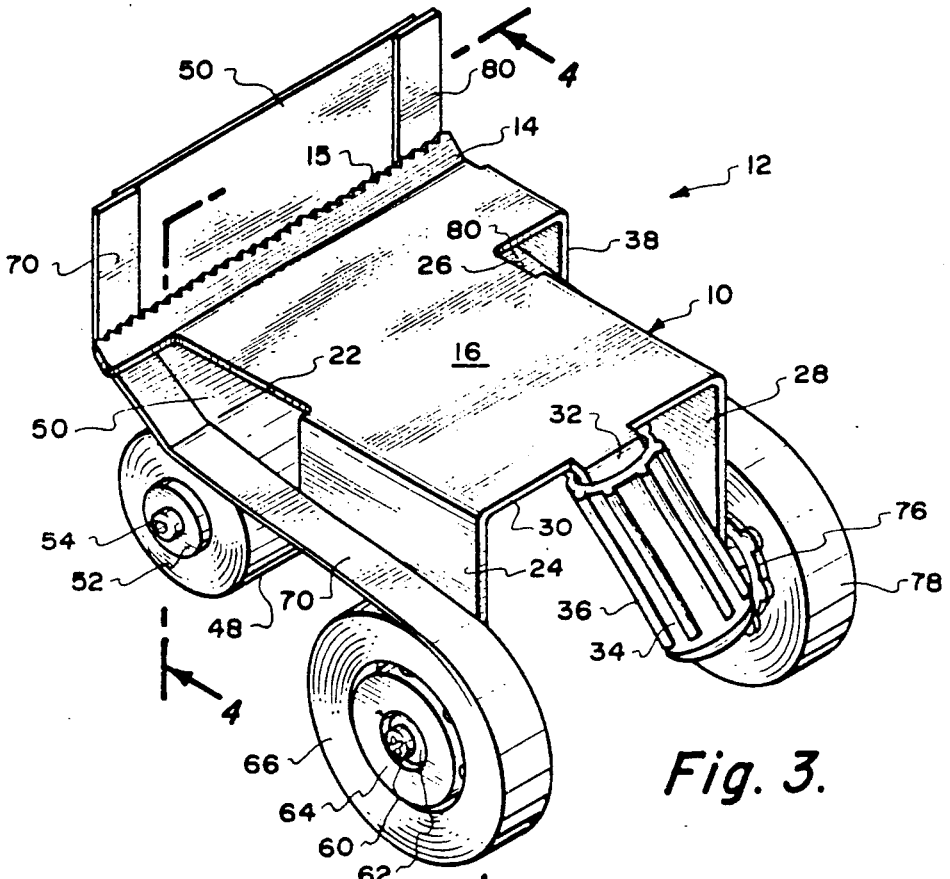
FIG. 3 is an isometric view of the masking machine of the present invention showing the masking machine in its assembled state.
Figure 4:
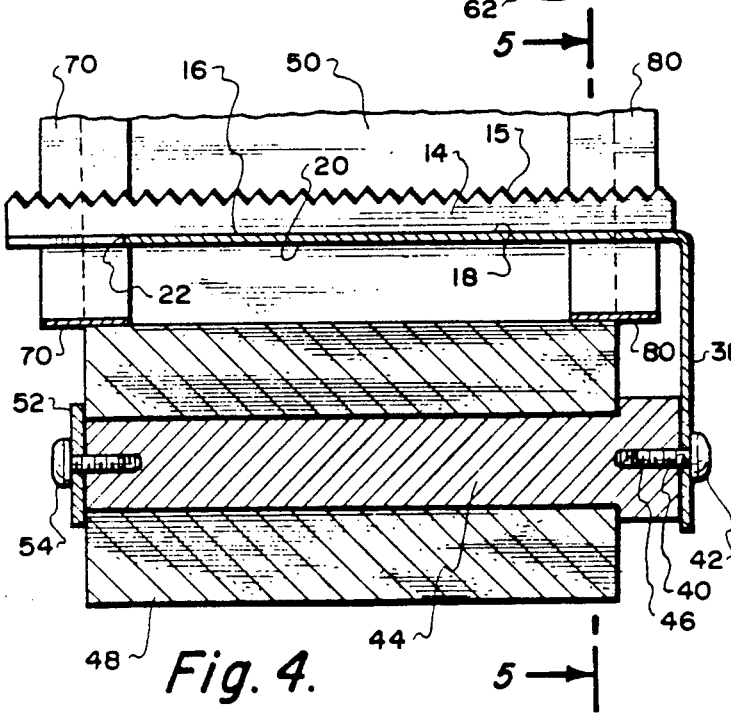
FIG. 4 is a cross-sectional view through the paper roll of the masking machine of the present invention taken along line 4—4 of FIG. 3.

Initially, the tape end 70 is placed in its proper position as shown in FIGS. 3 and 4 of the drawings to engage with the left side edge of the paper roll 48. In a similar manner the tape end 80 is caused to engage with the right side edge of the paper roll 48. Therefore, as the paper end 50 is automatically extended, the tape ends 70 and 80 are also automatically extended and at the same time are caused to be adhesively secured to the paper end 50. Unwinding of the paper end 50 from the roll 48 with automatically cause simultaneous unwinding of the tape from the tape rolls 66 and 78.

It is to be understood that with the operator grasping handle cover 34 that the paper end 50 is to be applied to the desired exterior structure with the lateral outer edges of the tape ends 70 and 80 then adhering to that exterior structure. Such an exterior structure is disclosed in phantom as numeral 84 within FIG. 5. Once the tape ends 70 and 80 are adhered to the exterior structure 84, manually moving of the machine 12 to cause extending of the paper end 50 will result in adhesively securing of the paper end 50 to this exterior structure thereby covering such.

WHAT IS CLAIMED IS:

1. A handle held masking machine comprising a housing having a front edge; masking material mounting means on said housing adapted for mounting a roll of masking material having spaced lateral edges for rotation about a masking material axis so that masking material from the roll can be conducted past the front edge of the housing; a handle attached to said housing and adapted to be grasped by a person using the masking machine, said handle having opposite ends and a longitudinal center axis between said ends oriented generally transverse to the axis of the roll of masking material; tape roll mounting means on said housing adapted for mounting first and second rolls of pressure sensitive adhesive coated tape having opposite edges for rotation about tape roll axes generally parallel to said masking material axis with each of said rolls of pressure sensitive adhesive coated tape adjacent a different lateral edge of the roll of masking material and positioned on the side of said masking material mounting means opposite the front edge of said housing, said tape roll mounting means being adapted to position the rolls of pressure sensitive adhesive coated tape along said tape roll axes with a portion of each roll of tape along the adjacent opposite edges of the rolls of pressure sensitive adhesive coated tape aligned with a portion of the roll of masking material along the adjacent lateral edge of the roll of masking material, and with a portion of each roll of tape projecting past the adjacent lateral edge of the roll of masking material, and so that tapes conducted from the rolls of tape past said front edge of said housing will contact and become adhered to masking material being conducted from said roll of masking material with portions of the tapes projecting past the lateral edges of the masking material; and cutting means along the front edge of said housing adapted for cutting the adhered together masking material and tape, wherein said housing includes a main body section having said front edge, an opposite back edge, a right side edge, a left side edge, and a bottom surface; and generally parallel flanges attached to said main body section at said right and left side edges and projecting past said bottom surface; said masking material mounting means is mounted on one of said flanges with said masking material axis extending between said right and left side edges of said main body section to position said roll of masking material located adjacent said bottom surface; said tape roll mounting means are mounted on said flanges; and one of said ends of said handle is attached to said main body section along said back edge generally centrally between said right and left side edges, with said handle extending away from said back edge in a position at which the handle can be grasped from any side.

2. A hand held masking machine according to claim 1 wherein said housing is of sheet material, said main body section is substantially planar, and said longitudinal center axis of said handle is disposed at an obtuse angle relative to the plane of said main body section and projects past said bottom surface of said main body section.

3. A hand held masking machine according to claim 1 wherein said housing is of sheet metal, and said main body section and said flanges are substantially planar.

4. A hand held masking machine according to claim 3 wherein said longitudinal center axis of said handle is disposed at an obtuse angle relative to the plane of said main body section and projects said bottom surface of said main body section.

5. A hand held masking machine according to claim 1 wherein said main body section and said flanges are substantially planar, said flanges include a first flange on said left side edge and an opposite second flange on said right side edge aligned with said first flange with said tape roll mounting means being mounted on said first and second flanges, and a third flange on said right side edge on which third flange said masking material mounting means is mounted.

6. A hand held masking machine according to claim 5 wherein said handle includes a planar handle frame portion included in said housing and attached to said main body section along said back edge, and a cover portion around said handle frame portion.

* * * * *